United States Patent [19]

Bothner

[11] Patent Number: 4,879,872

[45] Date of Patent: Nov. 14, 1989

[54] APPARATUS FOR POSITIONING A RING RAIL OF A TEXTILE MACHINE

[75] Inventor: Jakob Bothner, Goppingen-Jenhausen, Fed. Rep. of Germany

[73] Assignee: Zinser Textilmaschinen GmbH, Fed. Rep. of Germany

[21] Appl. No.: 315,343

[22] Filed: Feb. 23, 1989

[30] Foreign Application Priority Data

Feb. 23, 1988 [DE] Fed. Rep. of Germany ..... 3806203

[51] Int. Cl.[4] ..... D01H 7/10

[52] U.S. Cl. ..... 57/137; 57/1 R; 57/136

[58] Field of Search ..... 57/1 R, 136, 137, 119, 57/122

[56] References Cited

U.S. PATENT DOCUMENTS

| | | | |
|---|---|---|---|
| 1,121,942 | 12/1914 | Rhoades | 57/137 |
| 1,421,466 | 7/1922 | Hanson et al. | 57/137 |
| 2,479,497 | 8/1949 | Koolstra | 57/137 |
| 2,480,249 | 8/1949 | Kinsella | 57/137 |
| 3,022,625 | 2/1962 | Meadows | 57/137 |
| 3,844,102 | 10/1974 | Brooks | 57/137 X |

FOREIGN PATENT DOCUMENTS

| | | | |
|---|---|---|---|
| 710608 | 9/1941 | Fed. Rep. of Germany | 57/137 |
| 809159 | 7/1951 | Fed. Rep. of Germany | 57/137 |

*Primary Examiner*—John Petrakes

*Attorney, Agent, or Firm*—Shefte, Pinckney & Sawyer

[57] ABSTRACT

An apparatus for positioning aligned, elongate segments of a ring rail of a textile machine relative to vertically movable ring rail supports includes a centering bore and projection, a lateral guide bore and projection and a longitudinal guide bore and projection. The bores are selectively formed on the vertically movable ring rail supports and the ring rail segments and the projections are correspondingly formed on the other of the ring rail supports and the ring rail segments. The lateral guide bore and projection accommodates variations in the lateral extent of the ring rail segment and the longitudinal guide bore and projection accommodates variations in the longitudinal extent of the ring rail segment so that the ring rail segment is maintained at a predetermined position with respect to the spindles serviced by its associated rings while variations in its longitudinal and lateral extents which may occur due to temperature changes or the like are automatically acccommodated.

8 Claims, 2 Drawing Sheets

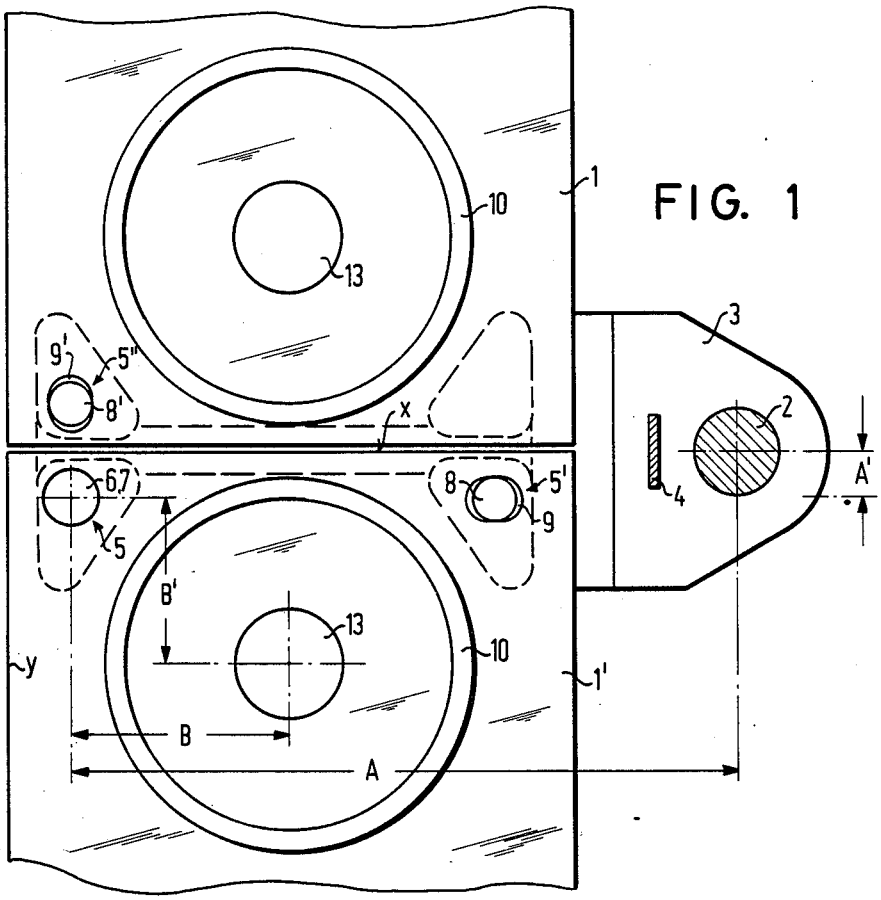
FIG. 1
FIG. 2
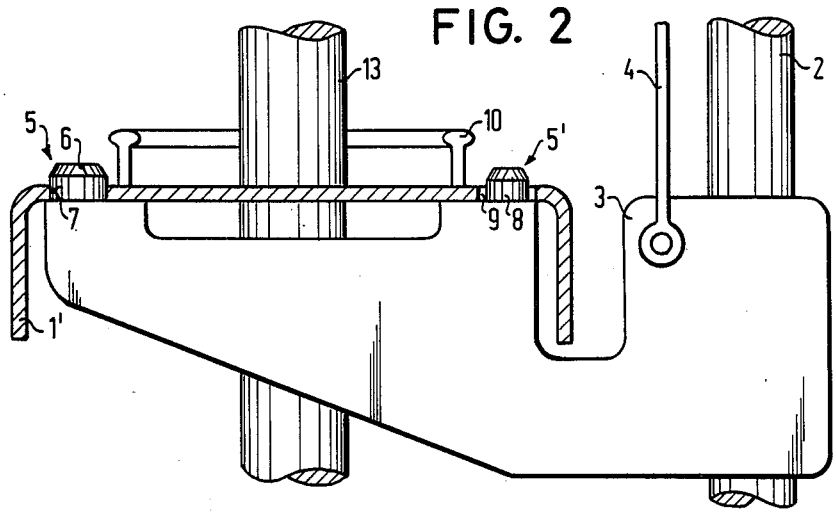

APPARATUS FOR POSITIONING A RING RAIL OF A TEXTILE MACHINE

BACKGROUND OF THE INVENTION

The present invention relates to an apparatus for positioning a ring rail of a textile machine and, more particularly, to an apparatus for positioning aligned, elongate segments of a ring tail relative to vertically movable ring rail supports.

In certain types of textile machines, such as ring spinning and twisting machines, yarn is guided onto a spindle by a traveler which travels around a ring. The rings associated with several adjacent spindles are mounted in a ring rail segment and the segments of an entire row of spindles are aligned with one another to form the ring rail for the row of spindles. In one known arrangement, the adjacent end portions of each adjacent pair of ring rail segments are commonly supported by a support and each support is movably mounted on a vertical guidepost for guided reciprocating vertical motion, whereby a guiding motion is imparted to the spinning operation.

To insure satisfactory travel of the yarn from the traveler onto the spindle, it is especially important that each ring be relatively precisely coaxially aligned with its associated spindle and this precise coaxial arrangement also minimizes the occurrence of yarn breaks. Accordingly, after repair or maintenance of the spinning machine, it is important to again align the rings with their associated spindles. However, a competing consideration is that the ring rails be easily removable and replaceable to facilitate a rapid and efficient maintenance of the spinning machine and this makes it difficult upon replacing the ring rail on to the spinning machine, to again achieve the precise coaxial alignment of the rings in their associated spindles.

In the case of spinning machines having long rows of spindles, it is especially difficult to position the ring rail segments. If the segments are abutted end to end, the ring rail may gain in length due to an increase in temperature, which causes the segments to expand. However, since the segments typically are not coupled to one another, they will not correspondingly return to their original unexpanded positions once the temperature decreases with the result that certain of the rings will no longer be coaxially aligned with their associated spindles.

It has been proposed in German Patentschrift No. 710 608 to precisely longitudinally guide the ring rail segments—that is, to position the segments transverse to the longitudinal axis of the ring rail. Additionally, German Patentschrift No. 809 159 proposes an arrangement of ring rail supports and posts for supporting the ends of the ring rail segments. However, proper alignment of the ring rail segments is difficult to achieve with the arrangement and the arrangement does not insure that the ring rail segments will remain reliably secure in their proper aligned position during the spinning operation, as is necessary to achieve the goal of error-free feed of the yarn during the spinning operation.

It has also been proposed in German Offenlegungsschrift No. 26 32 409 to provide the ends of the ring rail segments with projections and recesses which cooperate with one another in dovetail fashion. However, this arrangement requires additional components in the end portions of the ring rail segments, such as an attachment piece, and this tends to make this arrangement relatively expensive.

In German Patentschrift No. 27 55 590, an arrangement is proposed for providing the ends of the ring rail segments with compatibly configured bores and pegs.

SUMMARY OF THE INVENTION

The present invention provides, in a textile machine such as a ring spinning machine or the like having a row of spindles and a ring rail, the ring rail including a plurality of aligned, elongate ring rail segments, each ring rail segment carrying a plurality of rings, each ring being associated with a spindle and having a traveler for guiding yarn onto its associated spindle, each segment being supported at each end by a ring rail support and each ring rail support being vertically movable along a respective vertical guide, an apparatus for maintaining a ring rail segment at a predetermined position with respect to the spindles serviced by its rings. The apparatus includes a centering projection mounted on a selected one of the segment and one of its ring rail supports and a centering bore formed in the other of the segment and the one ring rail support, the centering bore being disposed at the intersection of a longitudinal axis generally parallel to the longitudinal edge of the segment and a lateral axis generally perpendicular to the longitudinal axis and generally parallel to the lateral edge of the segment. The centering bore is compatibly configured with respect to the centering projection relatively snugly receive the centering projection. The apparatus further includes a lateral guide projection mounted on a selected one of the segment and one of the ring rail supports and a lateral guide bore, formed in the other of the segment and the one ring rail support associated with the lateral guide projection, for receiving the lateral guide projection therein. The lateral guide bore has a cross-sectional extent longitudinally with respect to the segment and a transverse cross-sectional extend laterally with respect to the segment, the longitudinal extent of the lateral guide bore corresponding to a cross-sectional extent of the lateral guide projection longitudinally with respect to the segment such that the lateral guide projection is relatively snugly received therein and the lateral extent of the lateral guide bore being sufficiently greater than a cross-sectional extent of the lateral guide projection laterally with respect to the segment that the lateral guide projection is slidably movable along the lateral extent of the lateral guide bore, the lateral guide bore being located with its lateral extent generally aligned with the lateral axis through through the centering bore. The apparatus further includes a longitudinal guide projection mounted on a selected one of the segment and the ring rail support other than the ring rail support associated with the lateral guide bore and projection, and a longitudinal guide bore, formed in the other of the segment and the other ring rail support, for receiving a longitudinal guide projection therein. The longitudinal guide bore has a cross-sectional extent laterally with respect to the segment and a transverse cross-sectional extent longitudinally with respect to the segment, the lateral extent of the longitudinal guide bore corresponding to a cross-sectional extent of the longitudinal guide projection laterally with respect to the segment such that the longitudinal guide projection is relatively snugly received therein. The longitudinal extent of the longitudinal guide bore is sufficiently greater than a cross-sectional extent of the longitudinal guide projection longitudinally with respect to the segment that the longitudinal guide projection is slidably movable along the longitudinal extent of the longitudinal guide bore and the longitudinal guide bore is located with its longitudinal extent generally aligned with the longitudinal axis through the centering bore. Accordingly, the apparatus of the present invention maintains the segment at a predetermined position with respect to the spindles serviced by its rings while variations in its longitudinal and lateral extent which may occur due to temperature changes or the like are automatically accommodated.

According to one aspect of the present invention, a selected one of the centering bore and the centering projection can be formed with a generally non-cylindrical cross-section.

BRIEF DESCRIPTION OF THE DRAWINGS

FIG. 1 is a schematic top elevational view of the adjacent end portions of a pair of adjacent ring rail segments supported by a common ring rail support and showing the position maintaining apparatus of the present invention;

FIG. 2 is a vertical sectional view of the two ring rail segments in the present apparatus shown in FIG. 1, taken along a line passing through the center of the centering projection and the guide projection of the present apparatus;

DETAILED DESCRIPTION OF THE PREFERRED EMBODIMENTS

Figure 3:
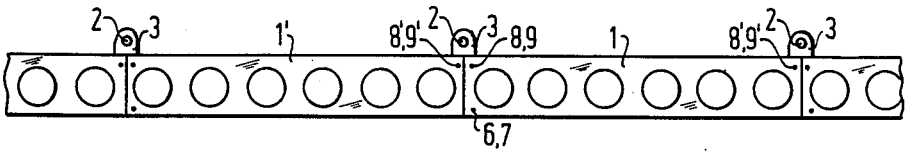
FIG. 3 is a schematic top elevational view of several aligned ring rail segments and their associated supports.

In FIG. 1–3 one embodiment of the ring rail segment positioning apparatus of the present invention is illustrated. In FIG. 1, the adjacent end portions of a pair of adjacent ring rail segments 1,1′ are commonly supported on a support 3. The support 3 is mounted on a vertical post 2 for vertical movement therealong. A lifter tape 4 is connected to the support 3 for vertically moving the support along the vertical guide post 2. The support 3 is freely rotatable about the vertical guide post 2.

Each ring rail segment 1,1′, as best seen in FIG. 3, includes a plurality of rings 10, each ring 10 being associated with a spindle 13 for spinning yarn thereon. To insure efficient and proper travel of the yarn from the ring onto the spindle and to minimize the occurrence of yarn breaks, each ring 10 is preferably coaxially positioned with respect to its associated spindle 13. In accordance with the present invention, an apparatus is provided for maintaining the rings 10 of each ring rail segment 1,1′ in its respective coaxial position with respect to their associated spindles 13 and the apparatus of the present invention includes a plurality of interconnection assemblies 5,5′,5″. The interconnecting assembly 5 includes a centering projection 6 mounted on the support 3 and a centering bore 7 formed in the ring rail segment 1′. The interconnecting assembly 5′ includes a lateral guide projection 8 mounted on the support 3 and an associated lateral guide bore 9 formed in the ring rail segment 1′. The interconnecting assembly 5″ includes a longitudinal guide projection 8′ mounted on the support 3 and an associated longitudinal guide bore 9′ formed in the ring rail segment 1. The centering bore 7 is compatibly configured with the centering projection 6 or snugly receive the centering projection therein. Each guide bore 9,9′ is configured with respect to its associated guide projection 8,8′, respectively, such that the guide projection is snugly received therein across one extent thereof yet is slidably movable along another extent thereof. Specifically, each guide bore 9,9′ has a widthwise extent generally corresponding to the cross-sectional extent of the respective guide projection 8,8′ therethrough such that the guide projection is relatively snugly received widthwise within the bore 9,9′, and an elongate extent which is sufficiently greater than the cross-sectional extent of the guide projection 8,8′ therethrough that the guide projection is slidably movable along the elongate extent, According to the embodiment illustrated in FIGS. 1–3, each ring rail segment 1,1′ includes a centering bore 7 and a guide bore 9 adjacent one end portion thereof and a second guide bore 9′ adjacent the other end thereof. Additionally, in FIGS. 1–3, the guide projection 8 associated with the ring rail segment 1′ is disposed diagonally to the guide projection 8′ of the adjacent rail segment 1.

The interconnecting assemblies 5,5′ and 5″ insure that, during the installation of each individual ring rail segment 1,1′, the ring rail segment is installed relative to the spindles associated with its rings such that its rings are coaxial with their associated spindles. This positioning relationship is achieved due to the orientation of the elongate extent of the guide bore 9, which is at the same end of the ring rail segment as the centering bore 7, such that the elongate extent of the bore 9 lies on an axis which passes through the center of the bore 7 and is generally parallel to the lateral edge X of the ring rail segment. Additionally, the elongate extent of the guide bore 9′ at the other end of the ring rail segment lies on an axis which passes through the center of the centering bore 7 and is generally parallel to the longitudinal edge Y of the ring rail segment. Thus, a predetermined lateral spacing A between the center of the vertical guide post 2 and the axis on which the guide bore 9′ is disposed is maintained. Likewise, a predetermined spacing B between the center of the spindles 13 and the axis on which the centering bore 7 and the elongate extent of the guide bore 9′ are disposed is also maintained. Moreover, a predetermined spacing A′ between the center of the vertical guide post 2 and the lateral axis on which the centering bore 7 and the guide bore 9 are disposed is maintained and the predetermined spacing B′ between the center of the spindle 13 and such lateral axis is also maintained.

Accordingly, each ring rail segment 1,1′ is maintained in its proper position with respect to the spindles 13 associated with its rings 10 by the three interconnecting assemblies 5,5′ and 5″ associated therewith and problem-free installation of the ring rail segment is assured, even if the support 3 is not secured against rotation about the vertical guide post 2.

Figure 4:
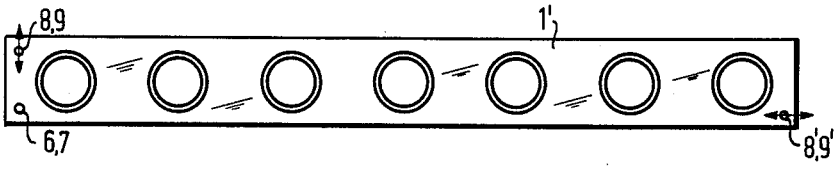
FIG. 4 is a top elevational view of a ring rail segment of the present invention.
Figure 6:
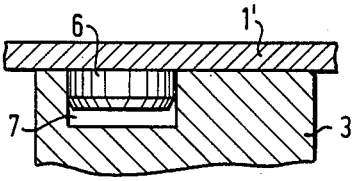
FIG. 6 is a vertical sectional view of another embodiment of one projection and its associated bore of the present apparatus.

In FIG. 4, another embodiment of the apparatus of the present invention is illustrated. A ring rail segment 1' has a selected one of an associated pair of a centering bore 7 and a centering projection 6 and the other of the centering bore and projection is disposed on the ring rail support 3. Likewise, a selected one of a guide bore 9 and an associated guide projection 8 is disposed adjacent one end portion of the ring rail segment 1' and the other of the guide projection and bore is disposed on the ring rail support 3. The guide projection 8 is movable along an axis passing through the center of the centering bore 7 and the centering projection 6, as shown by the directional arrow in FIG. 4. Additionally, the ring rail segment 1' has, at its other end portion, a selected one of a guide bore 9' and its associated guide projections 8' disposed thereon, the other of the guide bore and projection is disposed on the ring rail support 3 and the guide projection 8' is movable within the guide bore 9' along an axis passing through the center of the centering bore 7 and the centering projection 6, as shown by the directional arrow in FIG. 4. In FIG. 6, an embodiment of the present invention is illustrated in which the centering projection 6 is mounted to the ring rail 1' and the centering bore 7 is formed in the support 3.

Figure 5:
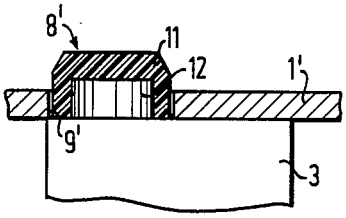
FIG. 5 is a vertical sectional view of one embodiment of one of the projections and its associated bore of the present invention.

In FIG. 5, an embodiment of the apparatus of the present invention is illustrated in which the guide projection 8' is formed as a steel post 12 which is enclosed is a plastic casing 11. This arrangement of a steel post enclosed in the plastic casing 11 can be used with each of the centering bore and centering projection arrangements as well as the other guide bore and guide projection arrangements. The steel post 12 can be sprayed with molten plastic to form the plastic casing 11 thereon or can be enclosed by a separately formed plastic casing. Additionally, the centering bores and the guide bores can be provided with plastic bushings.

Figure 7:
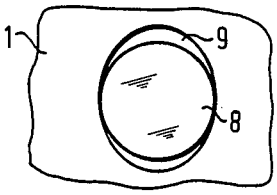
FIG. 7 is a top elevational view of one centering projection and its associated bore of one ring rail segment of FIG. 1.
Figure 8:
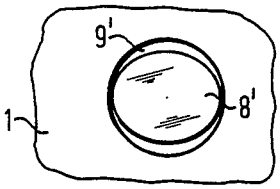
FIG. 8 is a top elevational view of another embodiment of a centering projection and its associated bore.

In FIGS. 7 and 8, two embodiments of a guide bore and projection arrangement of the present invention are illustrated. In FIG. 7, the guide projection 8 is formed as a generally cylindrical projection and the guide bore 9 is formed as an elongate slot having generally cylindrical ends compatibly configured with the cylindrical shape of the guide projection 8 which is the basic construction of the guide projection and bores 8,9 of FIGS. 1–3. In FIG. 8, the guide projection 8 is formed with a non-cylindrical cross-section such as, for example, an oval cross-section and the associated guide bore 9 is formed as a generally cylindrical bore or as an oval bore.

The present invention contemplates one particularly advantageous embodiment wherein each ring rail segment has a pair of bores formed in each end thereof and the supports 3 are formed with round centering projections and noncylindrical guide projections. With this arrangement, the ring rail segments can be used interchangeably on both sides of the spinning machine.

It will therefore be readily understood by those persons skilled in the art that the present invention is susceptible of a broad utility and application. Many embodiments and adaptations of the present invention than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a textile machine such as a ring spinning machine or the like having a row of spindles, a plurality of ring rail supports and a ring rail, the ring rail including a plurality of aligned elongate ring rail segments, each ring rail segment carrying a plurality of rings, each ring being associated with a spindle and having a traveler for guiding yarn onto its associated spindle, and each ring rail support being vertically movable along a respective vertical guide, an apparatus for maintaining a ring rail segment at a predetermined position with respect to the spindles serviced by its rings, said apparatus comprising:

a centering projection mounted on a selected one of the segment and one of its ring rail supports;

a centering bore formed in the other of the segment and said one ring rail support, said centering bore being disposed at the intersection of a longitudinal axis generally parallel to the longitudinal edge of the segment and a lateral axis generally perpendicular to the longitudinal axis and generally parallel to the lateral edge of the segment, said centering bore being compatible configured with respect to said centering projection to relatively snugly receive said centering projection;

a lateral guide projection mounted on a selected one of the segment and one of the ring rail supports;

a lateral guide bore, formed in the other of the segment and said one ring rail support associated with said lateral guide projection, for receiving said lateral guide projection therein, said lateral guide bore having a cross-sectional extent longitudinally with respect to said segment and a transverse cross-sectional extent laterally with respect to said segment, said longitudinal extent of said lateral guide bore corresponding to a cross-sectional extent of said lateral guide projection longitudinally with respect to said segment such that said lateral guide projection is relatively snugly received therein and said lateral extent of said lateral guide bore being sufficiently greater than a cross-sectional extent of said lateral guide projection laterally with respect to said segment that said lateral guide projection is slidably movable along said lateral extent of said lateral guide bore, said lateral guide bore being located with its lateral extent generally aligned with said lateral axis through said centering bore;

a longitudinal guide projection mounted on a selected one of the segment and the ring rail support other than said ring rail support associated with said lateral guide bore and projections; and a longitudinal guide bore, formed in the other of the segment and said other ring support, for receiving said longitudinal guide projection therein, said longitudinal guide bore having a cross-sectional extent laterally with respect to said segment and a transverse cross-sectional extent longitudinally with respect to said segment, said lateral extent of said longitudinal guide bore corresponding to a cross-sectional extent of said longitudinal guide projection laterally with respect to said segment such that said longitudinal guide projection is relatively snugly received therein, and said longitudinal extent of said longitudinal guide bore being sufficiently greater than a cross-sectional extent of said longitudinal guide projection longitudinally with respect to said segment that said longitudinal guide projection is slidably movable along said longitudinal extent of said longitudinal guide bore, said longitudinal guide bore being located with its longitudinal extent generally aligned with said longitudinal axis through said centering bore, whereby the segment is maintained at a predetermined position with respect to the spindles serviced by its rings while variations in its longitudinal and lateral extent which may occur due to temperature changes or the like are automatically accommodated.

2. In a textile machine, an apparatus according to claim 1 and characterized further in that the ring rail support associated with said centering bore and projection and with said lateral guide bore and projection is the same ring rail support and said ring rail support is further associated with a guide bore and projection of an adjacent ring rail segment.

3. In a textile machine, an apparatus according to claim 2 and characterized further in that said centering projection, said lateral guide projection and said guide projection of said adjacent ring rail segment are mounted on said ring rail support, said centering bore and said lateral guide bore are formed in said segment is formed in said adjacent ring rail segment.

4. In a textile machine, an apparatus according to claim 3 and characterized in that said centering bore of said ring rail segment and said guide bore of said adjacent ring rail segment are disposed on their respective ring rail segments such that one of said centering bores is disposed offset toward a respective longitudinal edge of its associated ring rail segment and said other guide bore is disposed offset toward an opposite longitudinal edge of its associated ring rail segment.

5. In a textile machine, an apparatus according to claim 1 and characterized further in that a selected one of said centering bore and said centering projection has a generally non-cyclindrical cross-section.

6. In a textile machine, an apparatus according to claim 1 and characterized further in that said centering bore is formed in said one ring rail support, said lateral guide bore is formed in said one ring rail support associated with said lateral guide projection, said longitudinal guide bore is formed in said other ring rail support and said centering projection, said lateral guide projection and said longitudinal guide projection are mounted on said ring rail segment.

7. In a textile machine, an apparatus according to claim 1 and characterized further in that said centering bore, said lateral guide bore and said longitudinal guide bore are formed of plastic and said centering projection, said lateral guide projection and said longitudinal guide projection are formed of steel.

8. In a textile machine, an apparatus according to claim 7 and characterized further in that said centering projection, said lateral guide projection and said longitudinal guide projection are each encased in a plastic casing.

* * * * *